US005297479A

United States Patent [19]

Negus

[11] Patent Number: 5,297,479

[45] Date of Patent: Mar. 29, 1994

[54] OIL FILTER CRUSHER APPARATUS

[75] Inventor: Joel A. Negus, Clarinda, Iowa

[73] Assignee: Lisle Corporation, Clarinda, Iowa

[21] Appl. No.: 971,076

[22] Filed: Nov. 3, 1992

[51] Int. Cl.[5] ..... B30B 15/16; B30B 9/04

[52] U.S. Cl. ..... 100/48; 100/53; 100/98 R; 100/116; 100/131; 100/269 R; 100/902

[58] Field of Search ..... 100/48, 53, 98 R, 116, 100/131, 269 R, 902, 915

[56] References Cited

U.S. PATENT DOCUMENTS

| | | | |
|---|---|---|---|
| 80,877 | 8/1868 | Rawson | 100/269 R |
| 370,203 | 9/1887 | McBride | 100/915 X |
| 2,128,630 | 8/1938 | Wright | 100/902 X |
| 2,904,097 | 9/1959 | Cohen | 100/53 |
| 2,916,985 | 12/1959 | Beach | 100/53 |
| 4,570,536 | 2/1986 | Dodd | 100/902 X |
| 4,970,950 | 11/1990 | Ahoste | 100/269 R |
| 5,060,564 | 10/1991 | Buford et al. | 100/131 X |
| 5,109,763 | 5/1992 | Morris et al. | 100/131 X |
| 5,174,199 | 12/1992 | King et al. | 100/902 X |
| 5,182,988 | 2/1993 | Styfhoorn | 100/131 X |

OTHER PUBLICATIONS

"Recovered Oil Can Save You Money In Two Ways" and miscellaneous advertisements, Professional Tool & Equipment News, (Oct./Nov. 1991) pp. 72,74 (and pages listed as having advertisements).

Brochure, "The Impacter Oil Filter Crusher", published by G. A. Morris Enterprises, Inc., Newbury Park, Calif 91320, (1990).

Convenient Automotive Services Retailer, Nov./Dec. 1991.

Advertisement for "Eliminator Oil Filter Crusher", published by Odyssey Manufacturing, Inc., Holland, Mich. 49423, (1990).

Advertisement for "No. 1875 Crusher", published by OTC Division, Owatonna, Minn. 55060, (May 1991).

Brochure, "The Brank the Pros Demand", published by Lincoln Lubricating Equipment, (1991).

Brochure, "Automotive Week", published by Automotive Week Publishing Co., Wayne, N.J. 07474-3495, (Sep. 1991).

*Primary Examiner*—Stephen F. Gerrity

*Attorney, Agent, or Firm*—Allegretti & Witcoff, Ltd.

[57] ABSTRACT

An improved oil filter crusher, includes a cylinder positioned over a movable platform. Upon initiation of operation of the crusher, the platform moves upwardly toward a base member of the cylinder to crush the oil filter and discharge oil therefrom.

16 Claims, 3 Drawing Sheets 80
82
24

24
54
52
42
42
40
38
50
38
49
37
70
72
22
62
62
35
39
41
46
48
36
36
64
34
44
44
32
33
30
60

24
80
82

34
70
64
66
68

36
36
64
34
44
44

42
40
88
36
36

13
13
40

74
72
22
74
49

OIL FILTER CRUSHER APPARATUS

BACKGROUND OF THE INVENTION

This invention relates to an apparatus for crushing motor vehicle oil filters and simultaneously recovering residual or waste oil from the filters.

The Environmental Protection Agency of the United States has promulgated rules declaring that waste oil constitutes a hazardous material. As such, waste oil must be carefully collected and then recycled or disposed of in accord with stringent disposal procedures. Heretofore, a significant source of waste oil has been the residual oil retained in used motor vehicle oil filters. Thus, appropriate techniques are required to recover the waste oil from such filters for purposes of recycling, proper disposal or other treatment. It is estimated that approximately half of the oil in such filters can be recovered by simply draining the filter after it is removed from the motor vehicle. The remaining oil in the filter cannot normally be recovered by draining and thus other techniques must be used.

It has been suggested that such additional techniques include the crushing of the filter and the collection of the oil during the crushing operation will result in the recovery of an additional 38% of the oil originally contained in the filter. The remaining amount (12%) does not appear to be recoverable.

In any event, the recovery of a significant amount of used motor vehicle oil can be effected by crushing of the filters. Recently various proposed structures for the crushing of oil filters and recovery of the oil released during the crushing operation have appeared in the marketplace. Typically, such oil filter crusher apparatus are comprised of a platform or anvil with a piston positioned over the anvil. A hydraulic operated piston is then positioned to descend onto the filter, crushing the filter and thereby extracting significant amounts of residual oil retained in the filter. The use of such crushing apparatus has been greeted with acceptance especially among those businesses responsible for changing the oil in motor vehicle engines. There has remained a need, however, for an improved oil filter crushing apparatus which is compact, efficient, durable, safe to operate and less costly.

SUMMARY OF THE INVENTION

In a principal aspect, the present invention comprises an improved oil filter crushing apparatus that generally includes a horizontal platform with vertical support members projecting therefrom upward through a base plate and connected to a piston of an operating cylinder. The underside of the base plate of the cylinder serves as an anvil against which an oil filter supported on the platform is driven by the vertical upward movement of the piston within the cylinder. The platform is retained within a protective housing for collecting the residual oil that is removed from an oil filter during the crushing operation. A drain at the bottom of the housing directs residual oil into a collection container. An access door is provided in the housing with an interlock that precludes operation of the crushing mechanism unless the door is closed. The anvil which is incorporated as part of the base plate of the cylinder includes a unique configuration to enhance the filter crushing operation. The entire assembly is especially compact, durable and relatively inexpensive.

Thus, it is an object of the invention to provide an improved oil filter crusher apparatus.

It is a further object of the invention to provide an improved oil filter crusher apparatus of the type wherein a platform for driving an oil filter against an anvil is movable vertically upward in response to actuation of a cylinder within a piston positioned over the platform.

It is a further object of the invention to provide an improved oil filter crusher apparatus having a base plate which includes an integral anvil and further includes a cylinder construction having a design which permits an elongated stroke.

Yet another object of the invention is to provide an improved oil filter crusher apparatus comprised of a minimum number of components and parts.

Yet another object of the invention is to provide an improved oil filter crusher apparatus which can easily collect and direct oil removed from a crushed oil filter to a central drain.

Yet another object of the invention is to provide an improved oil filter crusher apparatus wherein the oil filter can be easily and properly positioned within the apparatus to facilitate the crushing operation.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figures 6, 7, 8, 9, 10, 11, 12, 13:
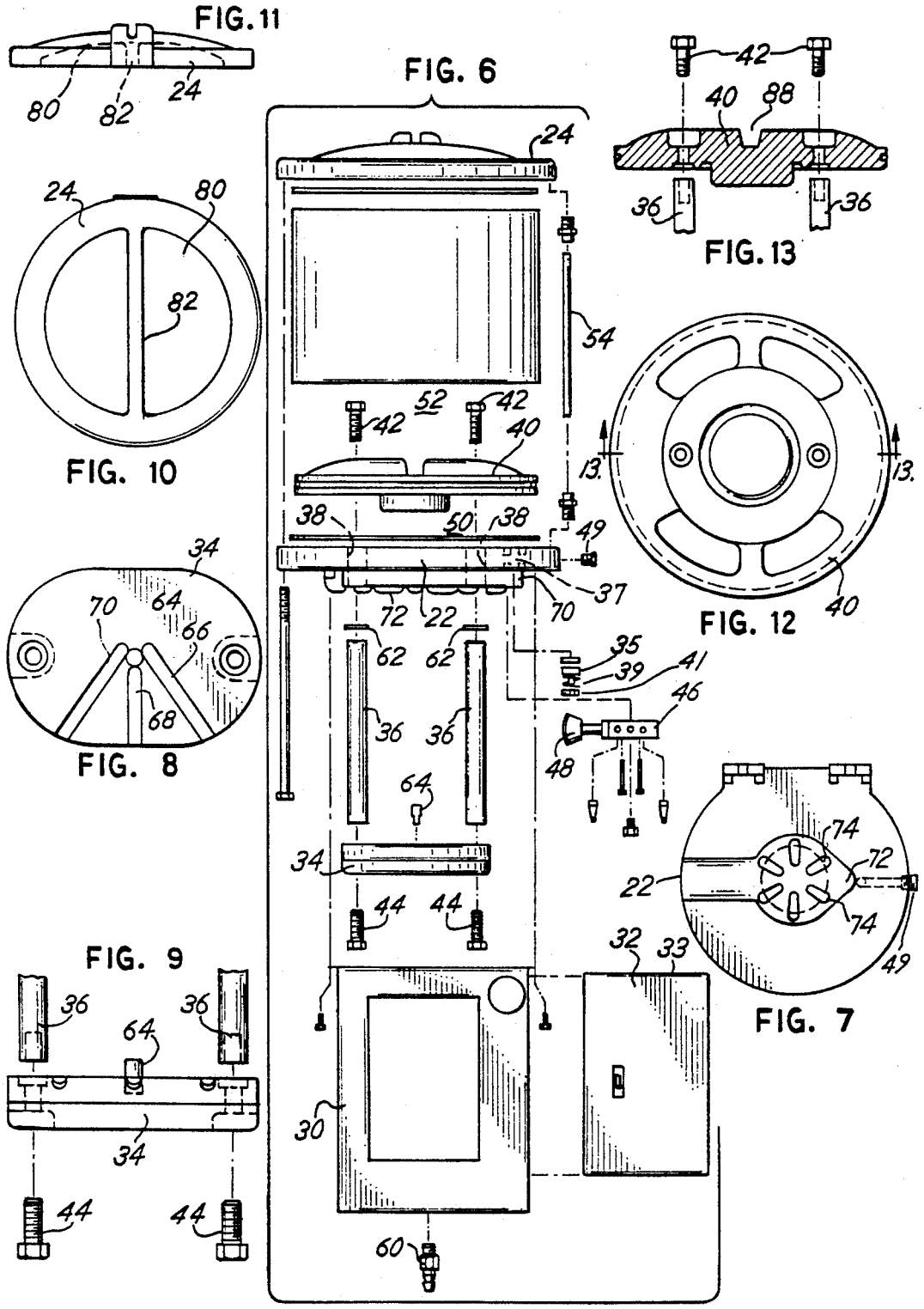
FIG. 6 is an exploded elevation of the component parts of the apparatus of FIG. 1.
FIG. 7 is a bottom plan view of the lower surface of the base member of the apparatus of FIG. 1.
FIG. 8 is a top plan view of the platform for supporting oil filter in the crusher apparatus of FIG. 1.
FIG. 9 is a front elevation of the platform of FIG. 8.
FIG. 10 is a plan view of the lower surface of the top or cover of the cylinder of the apparatus of FIG. 1.
FIG. 11 is a side elevation of the top cover illustrated in FIG. 10.
FIG. 12 is a top plan view of the piston of the cylinder of the apparatus of FIG. 1.
FIG. 13 is a section of the piston FIG. 12 taken along the line 13—13.

Referring to FIGS. 1-6, there is illustrated the improved oil filter crusher apparatus of the present invention. Generally, the apparatus comprises a cylinder 20 which includes a lower cylinder head or base plate 22, a top cylinder head, dome or cover 24 spaced from the base plate 22, a cylinder or tube 26 which defines the cylinder assembly in combination with the base plate 22 and dome or cover 24, and a series of spaced tie rods 28 about the periphery of the tube 26 for connecting the base plate 22 to the dome 24. Attached to the lower side of the base plate 22 is a housing 30 having a sliding door 32. The housing 30 has a floor and encloses the region or space beneath the base plate 22. As shown in FIG. 6, a horizontal platform or ram 34 which is attached to two spaced rods or support members 36 is positioned beneath the base plate 22. The rods 36 slidably project upwardly through congruent passages 38 in the base plate 22 and are rigidly connected to a piston 40 by means of bolts 42. Similarly, the rods 36 are affixed by means of bolts 44 to the platform or filter support member 34.

A manifold or control valve 46 with a control button 48 is also attached to the base member 22 and interfaces with fluid flow channels (not shown) milled or drilled in the base 22. Valve 46 controls connection of pressurized air from an inlet or fitting 49 to either the region 50 beneath the piston 40 or the region 52 above the piston 40. Thus, the manifold or valve 46 will provide for air flow or pressurized air flow through plate or member 22 into region 50 to drive the piston 40 and thus the platform 34 vertically upward. Alternatively, the control valve 46 will connect through the base plate 22 to a line 54 that connects to a passage (not shown) in the dome or cover 24 and thence to the region 52 above the piston 40.

In operation, when the button 48 is depressed, pressurized air flow is directed to the region 50. Then the piston 40 is driven vertically upward the maximum stroke. The button 48 may then be released and a spring return on a valve member (not shown) associated with the button 48 causes the valve 46 to return to an unactivated position to direct flow through the line 54 and thence region 52. This causes the platform 34 to respond to movement of the piston 40 downward thereby returning the platform 34 to its original down position.

Positioned within the housing 30 at the mid point of the floor or base in the preferred embodiment is a drain 60. As can be seen by reference to FIGS. 1 through 5 the drain 60 permits the draining of oil from the housing 30 into some type of container 61 for purposes of collection.

The access door or sliding door 32 is preferably made from a clear acrylic or plastic material. Additionally, the door 32 optionally interlocks with button control 48 and valve 46. That is, the button 48 is precluded from inward movement unless the door 32 is in the fully closed position. This arrangement insures that the button 48 is in the extended position so that the piston 40 and platform are in the pressurized down position and cannot be otherwise operated unless the door 32 is closed.

Figure 14:
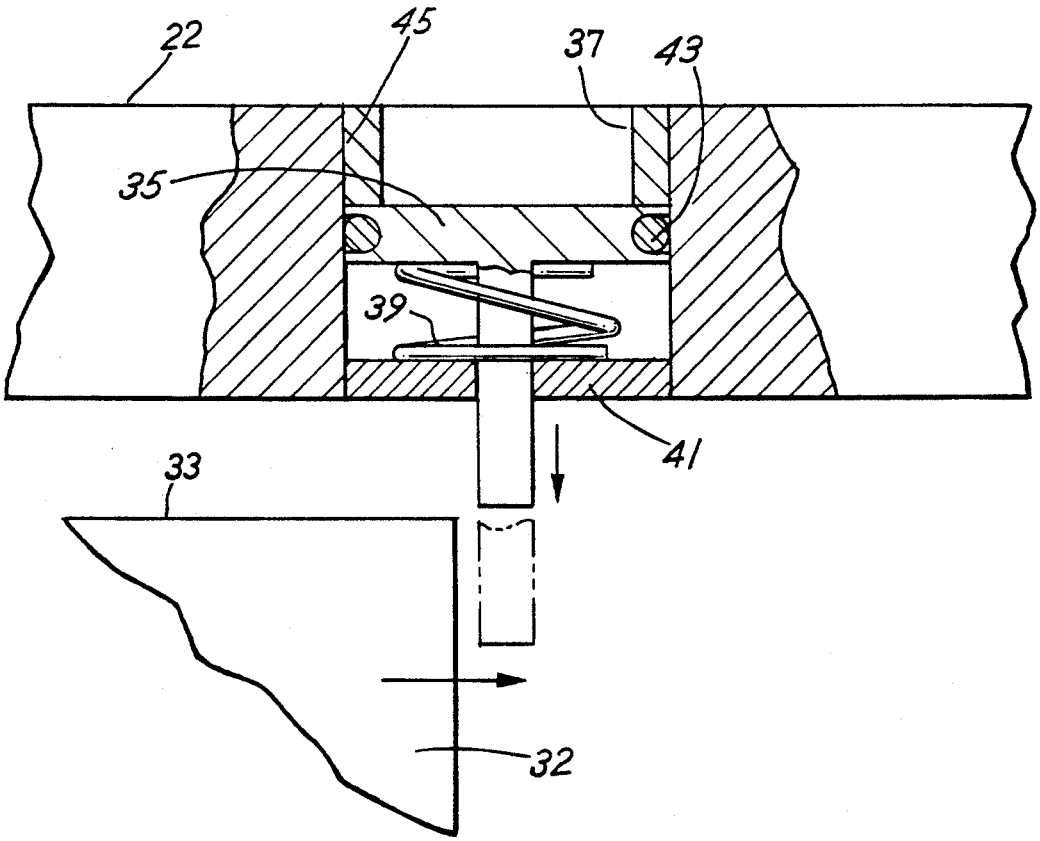
FIG. 14 is an enlarged cut away section view of a safety interlock feature.

One method of such interlocking arrangement is depicted by reference to FIG. 6. The upper edge 33 of door 32 coacts with the underside of button 48 preventing button 48 from being depressed unless the door 32 is closed so that the edge 33 is out of engagement with button 48. Further, as shown in FIG. 14, as button 48 is depressed to permit pressurized air to flow into reservoir or region 50, the pressurized air also actuates a plunger 35 positioned in a passage 37 in plate 22. Note passage 37 extends through plate 22 from reservoir 50, and that the pressurized air to the reservoir 50 is provided through fitting 49 and drilled passageway in plate 22. Plunger 35 is sealed to the wall of passage 37 by an O-ring seal 43 and is normally spring biased by spring 39 into a retracted position as shown in FIG. 14 against a retainer collar 45. A retainer plug 41 coacts with spring 39 to bias plunger 39 and to retain plunger 39 in passage 37. Upon air actuation, however, the plunger 35 extends (as shown in phantom) into the trackway for door 32, preventing door 32 from movement to the open position. The plunger 35 remains extended until the pressure in reservoir 50 is reduced to ambient pressure which occurs only when the piston 40 is returned to its full lowered position. The interlock associated with the plunger 35 is in addition to and independent of the mechanical interlock associated with button 48 and door edge 33. Thus the interlock associated with edge 33 may be omitted as may that associated with plunger 35. However, a safety interlock is preferred.

The rods 36 are sealed with respect to the base plate 22 by means of O-ring seals 62. The platform 34 includes a projecting center pin 64 which cooperates with and is designed to engage the center port of an oil filter so as to appropriately align the oil filter on the platform 34. As illustrated in FIGS. 8 and 9, the platform includes a plurality of generally radially extending drain slots 66, 68 and 70 which permit oil that is driven from a crushed oil filter to flow into the housing 30 and thence into the drain 60.

In operation, the rods 36 are equally radially spaced from the center point of the platform 34 which is generally congruent with the pin 64. The rods 36 are also equally spaced from one another. In the embodiment shown, only two rods 36 are depicted as being utilized. The symmetrical arrangement of the rods 36 prevents binding of the apparatus during its operation. More than two rods may be utilized. It is preferred, however, that the arrangement of the rods 36 remain symmetrical.

As another important feature of the invention, the base plate 22 serves a multiplicity of purposes. First, it acts as the lower head of the cylinder 20. Second, it provides the passageways for directing air flow into the region 50 and, in part, the region 52. Thirdly, it defines an anvil 70 and more particularly, a shaped anvil surface 72 which enhances the crushing operation for an oil filter. As depicted in FIG. 7, the anvil surface 72 is comprised of a plurality of radially extending ribs 74 which are equally spaced about the center point of the anvil 70. The ribs 74 are spaced from the center point and extend radially outward therefrom.

Another important feature of the invention is the construction of the cover or dome 24 in conjunction with the configuration of the piston 40. That is the dome 24 as illustrated in FIGS. 10 and 11 includes an inner concave surface 80 with a cross rib 82 that connects the opposite diametrical sides of the surface 80 to enhance the structural integrity of the dome or cover 24. The top surface of the piston 40 is compatible therewith as illustrated in FIGS. 12 and 13. The piston 40 thus includes a groove 88 which is cooperative with the rib 82 or in other words receives the rib 82. This particular construction enables the piston 40 to fit completely into the cover or dome 24 thereby enhancing the length of the stroke of the piston 40. Of course the bolts 42 are positioned in counterbores in the cover 40 thereby further enhancing clearance for movement of the piston 40.

Figure 1:
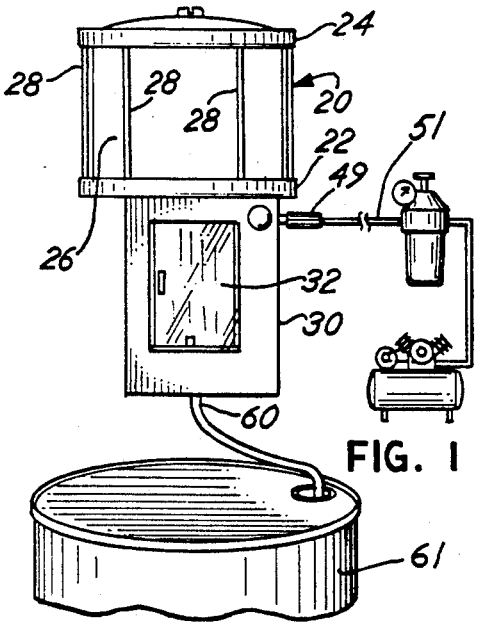
FIG. 1 is a front elevation view of the improved oil filter crusher apparatus of the invention positioned to receive a filter which is to be crushed.
Figure 2:
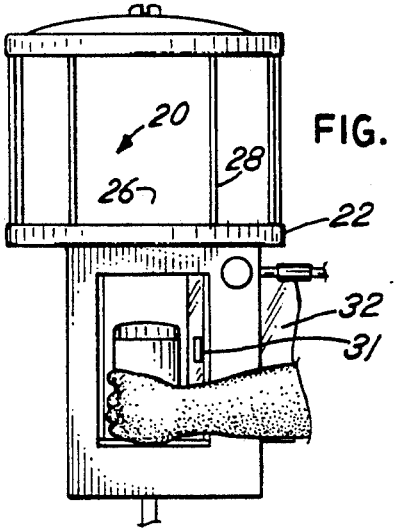
FIG. 2 is a front elevation view illustrating the manner in which an oil filter is positioned within the apparatus of FIG. 1.

FIGS. 1 through 5 illustrate the sequence of operation of the crusher apparatus shown in FIG. 1, the apparatus is in a rest position. An air line 51 is attached to hose fitting 49. With the platform 34 in the lowered position, it is possible to open the door 32 for access to the interior of housing 30 for insertion of a filter to be crushed. Because door 32 is open, it is not possible to depress the button 48 to activate the air flow into the region 50. Door handle 31 limits sliding movement of the door 31 to the open position as shown in FIG. 2. Note that the dome or crown of the oil filter is extended upwardly and the oil filter centerport is centered on pin 64.

Figure 3:
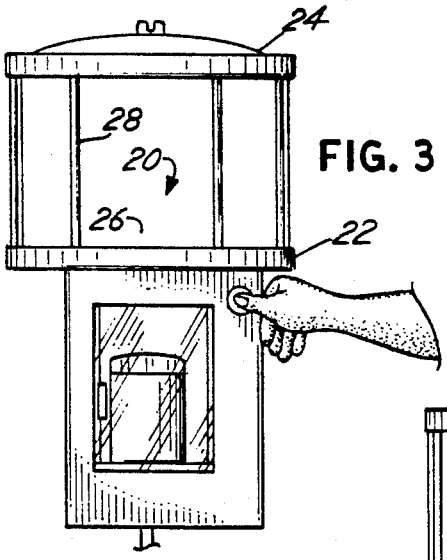
FIG. 3 is a front elevation view illustrating the initiation of the operation of the crusher of FIG. 1.
Figure 4:
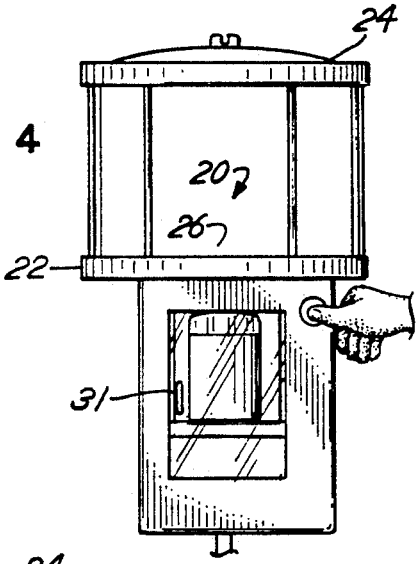
FIG. 4 is a front elevation view illustrating partial crushing of an oil filter in the crusher of FIG. 1.

Next referring to FIG. 3, the access door 32 is closed and the button 48 is depressed. This initiates upward movement of the platform 34 as illustrated in FIG. 4. Note, it is necessary to maintain manual pressure on the button 48 for continued pressurized air flow to region 50 and operation and movement of the platform 34.

Figure 5:
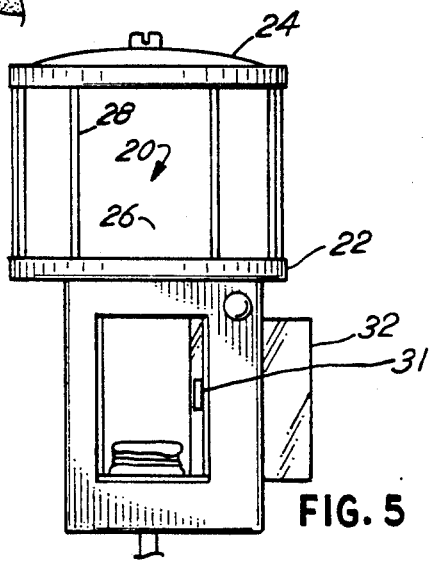
FIG. 5 is a front elevation view after a cycle of operation of the apparatus of FIG. 1 is completed and also depicts further a crushed oil filter.

After the oil filter is fully crushed, the button 48 is released. This automatically causes the valve 48 to direct return air to the region 52 thereby moving the platform 34 vertically downward as depicted in FIG. 5. The access door 32 may then be opened for removal of the crushed filter. Oil has, in the interim, drained down the drain slots 66, 68, 70 into the drain 60 of the housing 30. Note that with the invention, by providing upward movement of the oil filter as it is being crushed, oil may be more easily drained and observed draining into the housing 30 for free flow out of the drain 60.

In the foregoing description, there has been described a single embodiment of the invention. However, numerous changes or alterations may be made to the described structure. Thus, other alternative embodiments of the invention are considered to be within the scope of the invention. Among the features which are considered important are the upward movement of the platform 34 during the crushing operation, the construction of the anvil 72 and the platform 34 and the construction of the base member 22 in combination with the cylinder tube 26 and cover 24. These particular elements may be altered in configuration and shape and to some extent, may be juxtaposed. The invention is therefore to be limited by the following claims and equivalents.

What is claimed is:

1. An oil filter crusher for compressing an oil filter of the type comprised of a generally cylindrical container having a filter medium therein, said container defining a longitudinal axis, a dome at one end, an opposite end with a passage for connection to an engine oil circulation system, said crusher comprising, in combination:

a generally horizontal platform for receipt and support of the filter;

a plurality of platform support members fixed to the platform and projecting generally vertically from the platform;

a base member having a plurality of platform support member slide passages, each slide passage configured for sliding receipt of a single platform support member;

a cylinder mounted on the base member;

a piston reciprocally slidable in the cylinder in the vertical direction, the platform support members projecting into the cylinder and being attached to the piston for sliding movement therewith within the cylinder to transport the platform toward or away from the base member;

a housing attached to the base plate and surrounding the platform and support members between the platform and base member, said housing including a housing floor;

an access door to the housing for placement of a filter on the platform;

a lower fluid drain from the housing floor;

said platform movable vertically within the housing between a separated position spaced from the base member so as to receive a filter on the platform with the filter oil passage adjacent the platform for draining of oil from the filter and an adjacent position; and fluid control means for directing fluid against one side of the piston to drive the platform vertically upward toward the base member and simultaneously the piston vertically upward from the base member when the access door is closed to compress and crush an oil filter positioned between the platform and base member forcing excess oil from the crushed filter into the housing to be drained therefrom when the access door is closed.

2. The filter crusher of claim 1 including means for sealing between the support members and the slide passages.

3. The filter crusher of claim 1 wherein the fluid control means also includes means for directing fluid to drive the piston in the cylinder downward toward the base member.

4. The filter crusher of claim 1 wherein the platform includes a center point and the support members comprise at least two cylindrical, vertical rods equally, radially spaced from the center point and equally spaced from each other.

5. The filter crusher of claim 4 including means affixed to the platform for engaging and aligning the filter coaxially with a vertical axis through the center point.

6. The filter crusher of claim 1 wherein the base member includes a lower filter engagement surface for engaging the dome of a filter, said surface comprising means configured to simultaneously engage the dome at a multiple number of spaced points during initial engagement with the dome to thereby initiate multiple bending of the filter.

7. The filter crusher of claim 6 wherein the lower filter engagement surface comprises at least two depending ribs.

8. The filter crusher of claim 7 wherein the platform includes a center point and the ribs project radially from a vertical axis through the center point.

9. The filter crusher of claim 8 wherein the lower filter engagement surface comprises at least four depending ribs.

10. The filter crusher of claim 1 wherein the base member comprises one end of the cylinder and also comprises a filter dome engagement surface.

11. The filter crusher of claim 1 wherein the cylinder is comprised of said base member forming one end of the cylinder, said base member also serving as an anvil for crushing engagement with a filter, said cylinder having an opposite end, the opposite end of the cylinder being defined by an end plate spaced from the base member, said end plate having a concave surface with lateral edges and a diametrical rib connecting the lateral edges of the concave surface.

12. The filter crusher of claim 1 including interlock control means connected to the access door for disabling the fluid control means for driving the piston to drive the piston upward whenever the door is open.

13. The filter crusher of claim 12 wherein the piston is air actuated and the interlock control means comprises an air actuated locking plunger, and further wherein the access door is moveable along a pathway between an open and a closed position, said plunger being extendable from the base member into the pathway of the door to retain the door in a closed position when pressurized air is connected to the piston for movement of the platform toward the base plate.

14. The filter crusher of claim 1 wherein the platform includes a filter support surface having at least one drain slot for draining fluid into the housing.

15. The filter crusher of claim 14 wherein the platform includes a center point and a slot extending generally radially from around the center point of the platform.

16. An oil filter crusher for compressing an oil filter of the type comprised of a generally cylindrical container having a filter medium therein 1 said container defining a longitudinal axis, a dome at one end, an opposite end with a passage for connection to an engine oil circulation system, said crusher comprising, in combination:

a generally horizontal platform for receipt and support of the filter;

a plurality of platform support members fixed to the platform and projecting generally vertically from the platform;

a base member having a plurality of platform support member slide passages, each slide passage configured for sliding receipt of a single platform support member;

a cylinder mounted on the base member;

a piston reciprocally slidable in the cylinder in the vertical direction, the platform support members being attached to the piston for sliding movement therewith to transport the platform toward or away from the base member;

a housing surrounding the platform and support members including a housing floor;

an access door to the housing for placement of a filter on the platform, said access door movable along a pathway between an open and a closed position;

a lower fluid drain from the housing floor;

said platform movable vertically between a separated position spaced from the base member so as to receive a filter on the platform with the filter oil passage adjacent the platform for draining of oil from the filter and an adjacent position;

fluid control means for directing fluid against at least one side of the piston to drive the platform vertically toward the base member and simultaneously the piston vertically from the base member when the access door is closed to compress and crush an oil filter positioned between the platform and base member forcing excess oil from the crushed filter into the housing to be drained therefrom when the access door is closed; and interlock control means connected to the access door for disabling the fluid control means for driving the piston to drive the piston vertically upward whenever the door is open, said interlock control means comprising a fluid actuated locking plunger, said plunger extendable from the base member into the pathway of the access door to retain the door in closed position when pressurized fluid is connected to the piston for movement of the platform toward the base plate.

* * * * *